US008740123B2

(12) United States Patent
Titus et al.

(10) Patent No.: US 8,740,123 B2
(45) Date of Patent: Jun. 3, 2014

(54) REPLACEABLE WEAR ELEMENT FOR ROLLING MILL LAYING HEAD

(75) Inventors: David G. Titus, West Boylston, MA (US); Raymond P. Dauphinais, Marlborough, MA (US); Daryl L. Moore, Worcester, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 469 days.

(21) Appl. No.: 13/217,404

(22) Filed: Aug. 25, 2011

(65) Prior Publication Data

US 2013/0048773 A1 Feb. 28, 2013

(51) Int. Cl.
*B21C 47/14* (2006.01)

(52) U.S. Cl.
USPC ..... 242/361

(58) Field of Classification Search
CPC ..... B21C 47/02; B21C 47/14; B21C 47/143
USPC ..... 242/360, 361–361.5, 363
See application file for complete search history.

(56) References Cited

U.S. PATENT DOCUMENTS

| | | | |
|---|---|---|---|
| 2,215,523 | A | 9/1940 | Haushalter |
| 2,227,969 | A | 1/1941 | Haushalter |
| 2,481,931 | A | 9/1949 | Kester |
| 2,675,283 | A | 4/1954 | Thomson |
| 3,008,779 | A | 11/1961 | Spriggs |
| 3,009,474 | A | 11/1961 | Crichton |
| 3,362,765 | A | 1/1968 | Pierce |
| 3,575,787 | A | 4/1971 | Selker |
| 4,540,294 | A | 9/1985 | Gerling |
| 5,312,065 | A | 5/1994 | Shore |
| 6,098,909 | A | 8/2000 | Kueppers |
| 6,769,641 | B2 | 8/2004 | Pariseau |
| 7,011,264 | B2 | 3/2006 | Shen |
| 7,086,783 | B2 | 8/2006 | Shore |
| 7,101,086 | B2 | 9/2006 | Klier |
| 2003/0122017 | A1 | 7/2003 | Pariseau |

FOREIGN PATENT DOCUMENTS

| | | | |
|---|---|---|---|
| EP | 0920930 | A2 | 6/1999 |
| GB | 1175403 | A | 12/1969 |
| WO | 0044512 | A1 | 8/2000 |

OTHER PUBLICATIONS

PCT International Search Report mailed Dec. 5, 2012 corresponding to PCT International Application No. PCT/US2012/049816 filed Aug. 7, 2012 (12 pages).

*Primary Examiner* — William E Dondero

(57) ABSTRACT

Selectively replaceable wear elements for rolling mill laying heads. One replaceable wear element forms the end ring guide surface and is installed within the end ring inner diameter without removing the guide ring from the laying head. A plurality of wear element bodies may be installed about one or more portions of the end ring guide surface inner diameter. Size, configuration and material properties of the end ring guide surface wear element bodies may vary for different sections within the ring guide inner diameter. Another replaceable wear element is a tripper paddle that forms a laying head tripper mechanism guide surface. The tripper paddle and guide surface wear element bodies are replaceable external the end ring without removing the end ring or tripper mechanism from the laying head. Either or both types of wear element may be used in a laying head.

20 Claims, 15 Drawing Sheets

REPLACEABLE WEAR ELEMENT FOR ROLLING MILL LAYING HEAD

BACKGROUND

1. Field

Embodiments of the present invention relate to rolling mill laying heads and more particularly to replaceable wear elements for guide ring shrouds in laying heads.

2. Description of the Prior Art

Rolling mill laying heads form moving rolled elongated material into a series of helical continuous loop rings. Those rings may be further processed downstream by bundling them into coils of any desired number of helical turns. Known laying heads are described generally in U.S. Pat. Nos. 5,312,065; 6,769,641; and 7,011,264, the entire contents of all of which are hereby incorporated by reference as if fully contained herein.

As described in these patents rolling mill laying heads include a rotating quill that discharges the elongated material into a radially outwardly flared section, where it is received in the entry end an elongated hollow structure, such as for example a hollow tubular laying pipe. The laying pipe or other elongated hollow structure has a curved intermediate portion that is surrounded by the quill's flared section and an end portion that projects radially outwardly from and generally tangential to the quill's rotational axis. The rotating quill and the laying pipe hollow elongated structure in combination conform the rolled material into a helical curved shape. The laying pipe or other substitute hollow elongated structure may be replaced with one of a different profile and/or diameter in order to reconfigure the laying head to accommodate different dimensioned rolled material.

Further helical profiling of the rolled material is accomplished in a rotating helical guide that includes troughs for receiving the rolled material about its outer circumference. The helical guide described in U.S. Pat. No. 6,769,641 is of segmented, sector-shaped, modular rim construction with the circumferential troughs formed within the rim sectors. When it is desired to reconfigure the laying head to accommodate different dimensioned rolled material all of the rim sectors are changed out with another set having different trough profile and/or helical pitch needed to coil the new material. Whenever a specific trough segment becomes worn in service use, its entire rim sector structural member is replaced with a new one.

A generally annular ring or shroud, also commonly referred to as an end ring or guide ring, has a guide surface that circumscribes the laying pipe discharge end and helical guide, so that the elongated material is confined axially and radially as it is discharged in now fully coiled configuration to a conveyor belt for subsequent bundling and other processing. A pivoting tripper mechanism, including one or more tripper paddles, may be positioned at approximately the six o'clock or bottom position of the end ring/shroud distal the quill. Varying the pivot attack angle of the tripper mechanism relative to the ring/shroud inner diameter surface is useful to control elongated material coiling, for example to compensate for varying elongated material plasticity thickness, composition, rolling speed and cross sectional structure. The tripper paddle top surface is a control surface that is in rubbing contact with the elongated rolled material as it passes through the laying head to the discharge conveyor structure. That rubbing contact in turn causes wear or ablation of the paddle. In the past the tripper mechanism had to be separated from the laying head in order to remove and replace the end ring.

The end ring or shroud needs periodic replacement. Its inner diameter guide surface is also a wear surface that is in rubbing contact with the elongated rolled material as it passes through the laying head to the discharge conveyor structure. The rubbing contact in turn causes wear or ablation of the ring internal guide surface. Often the wear pattern about the end ring is not uniform. Under many circumstances it is found that wear proximal the six o'clock position on the ring and the tripper mechanism is more pronounced than in other circumferential portions of the ring. From a wear resistance point of view it is desirable to form the ring wear surface from relatively hard steel and further desirable to perform further surface hardening and heat treatment, but such wear treatment steps must be balanced with ease and cost of ring fabrication.

The ring/shroud structure often is fabricated from steel sheet that is rolled into a generally annular plan form having a straight cylindrical or frusto-conical, outwardly flaring circumferential walls in the axial dimension. Additional reinforcement flanges, rings and gussets are added to the annular ring. Design trade-offs require compromises between ring material wear resistance properties and fabrication ease/cost. Harder steel grades are generally more difficult to fabricate into rolled annular shapes. Post-fabrication heat treatment and other hardening processes may deform a fabricated end ring. Alternatively, if it is desired to form portions of the end ring with castings, they are more difficult to surface harden than comparable fabricated components.

In the past the only recourse to repair a worn guide end ring/shroud wear surface was to remove and replace the entire end ring with a new one. Excluding the worn wear surface, the remainder of the end ring is otherwise functionally and structurally sound for continued service. Due to the massive end ring structure and how it interoperates with the other laying head components, guide ring replacement is expensive and requires extended laying head downtime during the replacement service operation.

SUMMARY

Accordingly, embodiments of the present invention include a selectively replaceable guide ring wear element body for a laying head end ring that is installed within the inner diameter of the end ring. The wear element body, when installed in the guide ring forms a guide surface for the elongated material that is constrained within the ring. When the wear element body is deemed to require replacement, the old one is removed from the end ring inner diameter and replaced with a new one. A plurality of wear element bodies may be installed about one or more portions of the end ring inner diameter and they form the guide surface. Size, configuration and material properties of the wear element bodies may vary for different portions within the ring guide guide surface within the end ring inner diameter. For example, a wear element body intended for installation in the six o'clock position within the ring guide inner diameter may have harder material properties or greater thickness than those for other portions of the ring guide, and/or may be adapted for quicker removal and reinstallation than for other portions of the ring guide. Some portions of the end ring may not have replaceable wear elements while other circumferential portions incorporate replaceable wear elements. Another type of wear element embodiment of the present invention is a tripper paddle forming a tripper mechanism control surface. The wear element bodies within the end ring inner diameter and the tripper paddles are replaceable external the end ring without removing the tripper mechanism from the laying head.

Another exemplary embodiment includes a selectively replaceable guide ring wear surface for a laying head guide ring, including a wear element body having a curved inner surface defining at least a portion of the guide surface that is oriented within the ring inner diameter. The wear element body has an outer surface having a profile conforming to the guide ring inner diameter that is adapted for mated coupling with the guide ring inner diameter. The wear element body also has an engagement surface adapted for mating engagement with a fastening element that is also coupled to the end ring. When the wear element body is engaged with the fastening element and end ring, it forms a portion of the guide ring wear surface within the end ring inner diameter. In some embodiments the guide ring and/or its replaceable wear surface include clearance notches to facilitate tripper paddle replacement and clearance for tripper functional operation. The wear element surfaces may be replaced without removing the tripper mechanism from the laying head system.

Another exemplary embodiment includes a method for selectively replacing a guide ring wear surface defined within the inner diameter of a laying head guide ring, by providing a wear element body having a curved inner surface defining at least a portion of the guide surface and an outer surface having a profile conforming with the guide ring inner diameter that is adapted for mated coupling with the guide ring inner diameter, and an engagement surface adapted for mating engagement with a fastening element that is coupled to the end ring. The wear element body, when engaged with the fastening element and end ring, forms a portion of the guide ring wear surface. The method further provides mating the wear body outer surface with a corresponding surface of the end ring inner diameter. After the mating step the method provides for fastening the fastening element to the end ring and the wear body engagement surface, thereby forming at least a portion of the end ring wear surface within the wear body inner diameter.

Another exemplary embodiment includes a laying head system for coiling hot rolled elongated material, comprising a quill rotating about an axis, for discharging elongated material there from. A pipe support is coaxial with the quill rotational axis. An elongated hollow member, such as a laying pipe, is coupled to the pipe support, for passage of elongated material there through. The laying pipe has a first end generally aligned with the quill rotational axis for receiving elongated material discharged from the quill, and a second end radially spaced from the rotational axis for discharging elongated material generally tangentially relative to the rotational axis. The system also includes a generally annular end ring coaxial with the quill rotational axis, for guiding elongated material discharged from the laying pipe second end into a continuous coil that is in turn discharged from the end ring. The guide ring has an inner diameter radially and axially circumscribing the laying pipe second end and further defines respective axial sides proximal and distal the quill. A pivoting tripper is coupled to the end ring along the distal side by a pivotal axis that is generally tangential to the end ring inner diameter, for selectively orienting the elongated material coil discharged from the end ring by varying pivotal angle between the tripper and the end ring. The tripper mechanism has a tripper control surface that in cooperation with the adjoining end ring guides discharged elongated material onto the awaiting conveyor into a formed loop. The guide ring of this system also has a selectively replaceable guide ring wear surface wear element body lining the end ring inner diameter, having: a curved inner surface defining at least a portion of the guide surface; and an outer surface having a profile conforming with the guide ring inner diameter that is adapted for mated coupling with the guide ring inner diameter. The wear surface element body also has an engagement surface. A fastening element engaged with the wear surface element body engagement surface and the end ring, couples the wear element body to the end ring, so that wear surface element body curved inner surface forms a portion of the guide ring wear surface within the end ring inner diameter. The tripper mechanism control surface is a tripper paddle that is selectively replaceable external the end ring. The tripper mechanism does not have to be removed from the laying head in order to replace the wear element body or tripper paddle.

These and other embodiments can be achieved in accordance with the present invention by a laying head system for coiling hot rolled elongated material, including a quill rotating about an axis, for discharging elongated material there from. A pipe support is coaxial with the quill rotational axis. A hollow elongated member, such as a laying pipe, is coupled to the pipe support, for passage of elongated material there through. The laying pipe has a first end generally aligned with the quill rotational axis for receiving elongated material discharged from the quill, and a second end radially spaced from the rotational axis for discharging elongated material generally tangentially relative to the rotational axis. In this system a generally annular end ring is coaxial with the quill rotational axis, for guiding elongated material discharged from the laying pipe second end into a continuous coil that is in turn discharged from the end ring. The annular end ring/shroud has an inner diameter radially and axially circumscribing the laying pipe second end, and defines respective axial sides proximal and distal the quill, as well as an axially inset notch. The inset notch further defines a notch face surface. This embodiment includes a pivoting tripper coupled to the end ring along the distal side by a pivotal axis that is generally tangential to the end ring inner diameter. The tripper selectively orients the elongated material coil discharged from the end ring by varying pivotal angle between the tripper and the guide surface. The tripper has a tripper control surface inset within and abutting the end ring notch that in cooperation with the adjoining notch face guides discharged elongated material into a formed loop. The guide ring/shroud of this system embodiment has a selectively replaceable guide ring wear surface wear element body having a curved inner surface defining at least a portion of the guide surface and notch face. The wear element body also has an outer surface having a profile conforming to the guide ring inner diameter that is adapted for mated coupling with the guide ring inner diameter, as well as an engagement surface. In this system embodiment a fastening element is engaged with the wear surface element body engagement surface and the end ring, for coupling the wear element body to the end ring, so that wear surface element body curved inner surface forms a portion of the guide ring wear surface.

The features of the present invention embodiments may be applied jointly or severally in any combination or sub-combination by those skilled in the art. Further features of embodiments of the present invention, and the advantages offered thereby, are explained in greater detail hereinafter with reference to specific embodiments illustrated in the accompanying drawings, wherein like elements are indicated by like reference designators.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
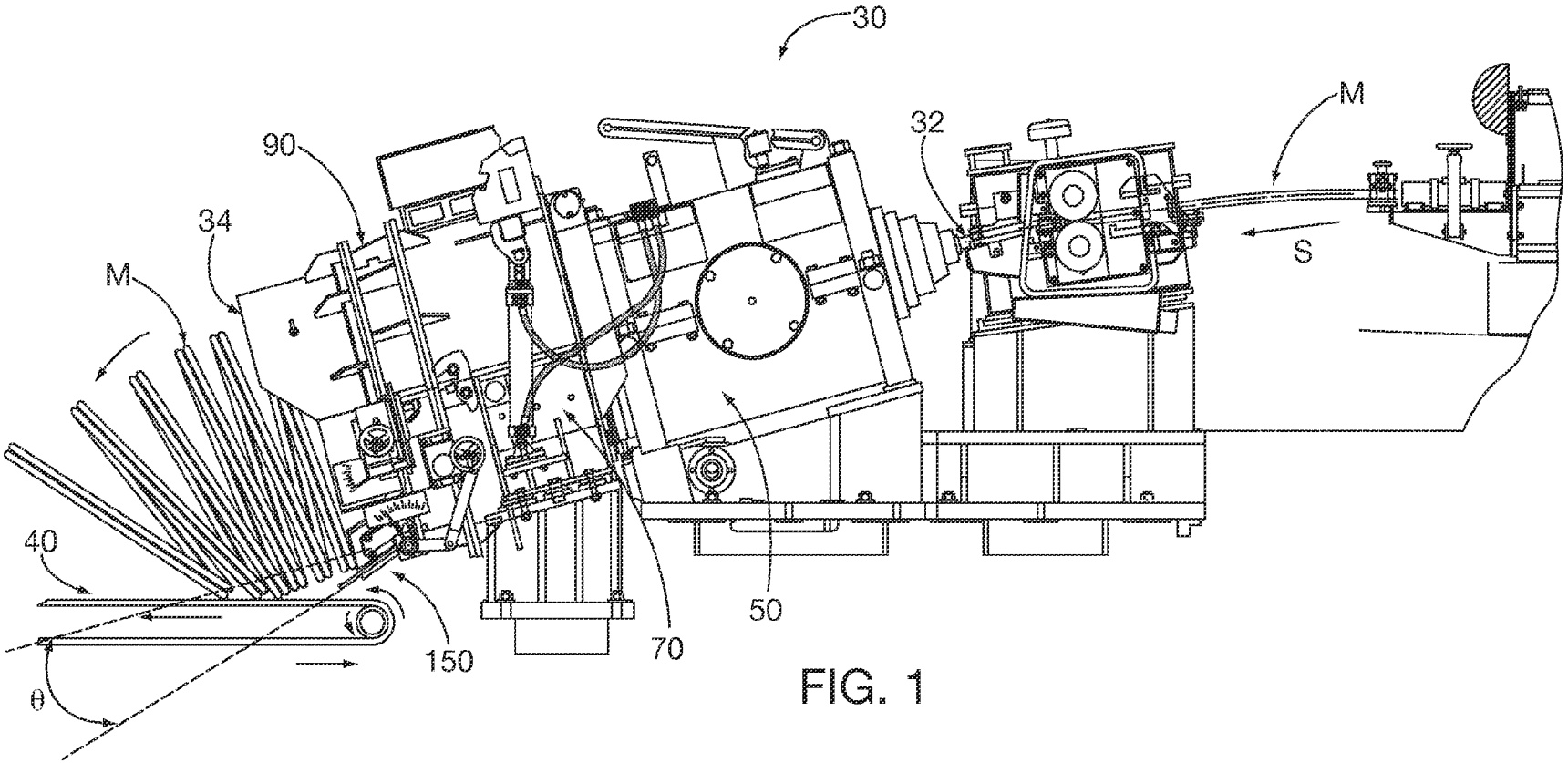
FIG. 1 shows a side elevational view of a laying head system, in accordance with an exemplary embodiment of the present invention.
Figure 2:
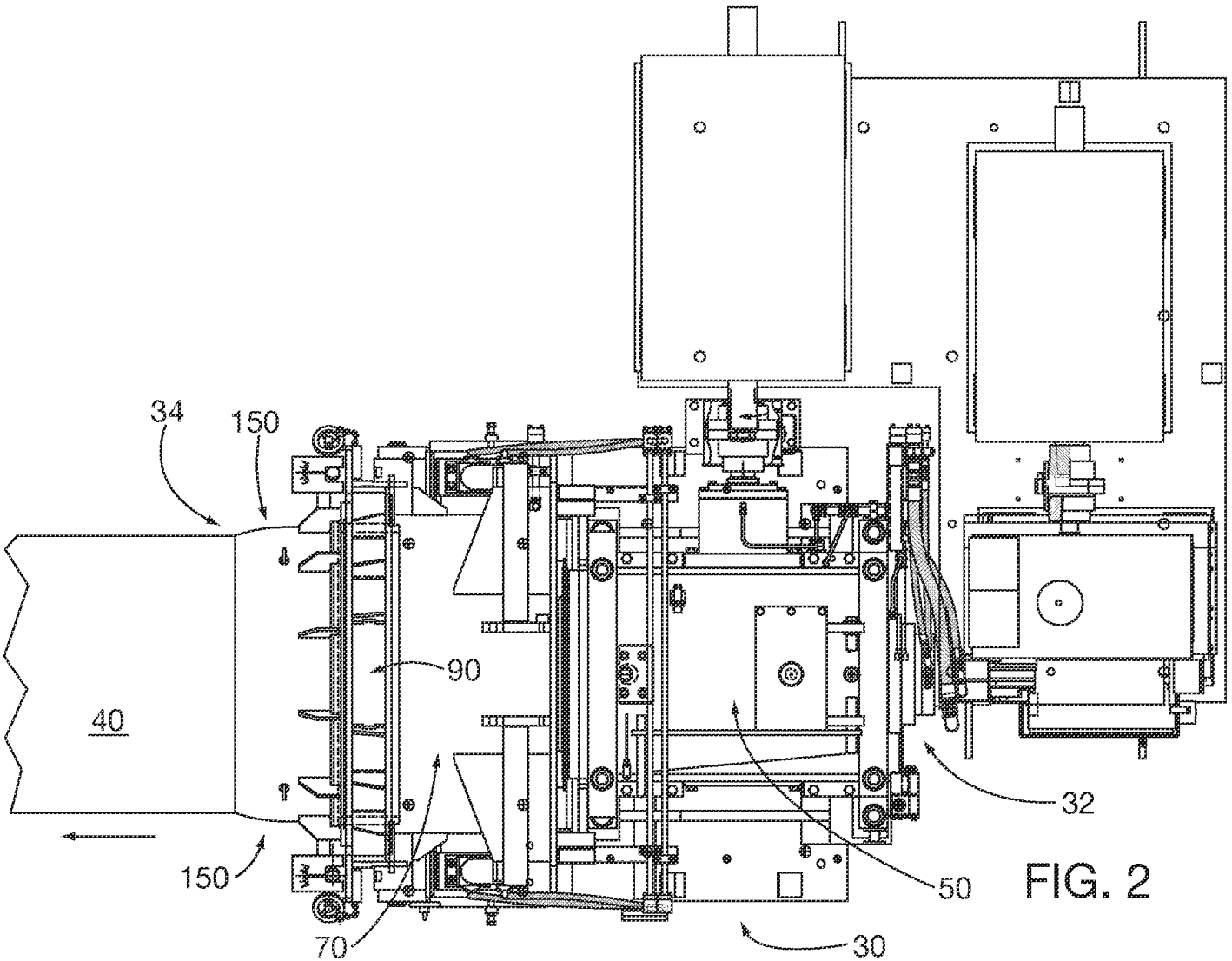
FIG. 2 shows a top plan view of the laying head system of FIG. 1, in accordance with an exemplary embodiment of the present invention.
Figure 3:
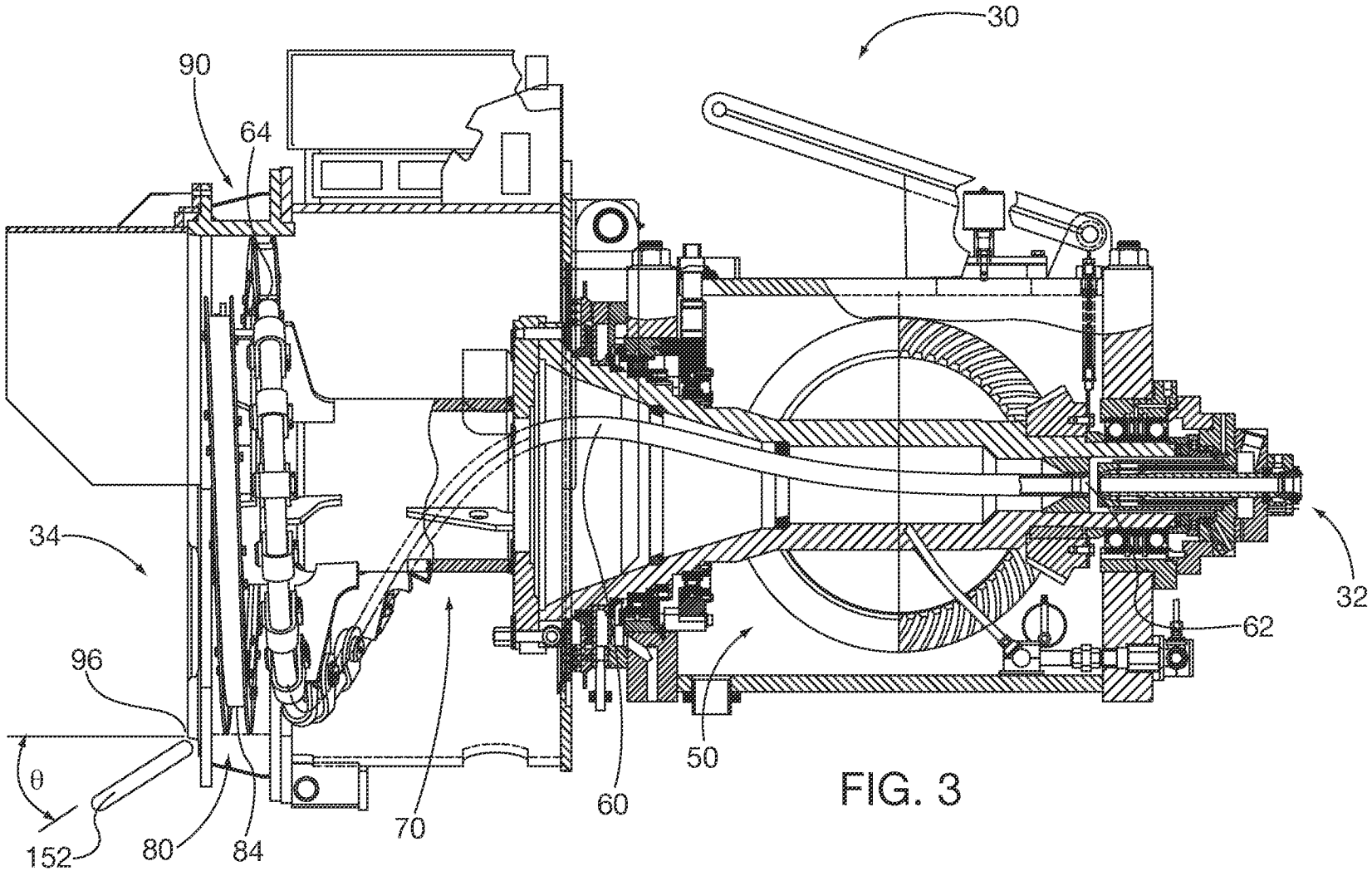
FIG. 3 shows a sectional elevational view of the laying head system of FIG. 1, including its end ring and tripper mechanism, in accordance with an exemplary embodiment of the present invention.

After considering the following description, those skilled in the art will clearly realize that the teachings of the present invention can be readily utilized in rolling mill laying heads and more particularly to replaceable wear elements for guide ring shrouds in laying heads. The present invention facilitates selective rapid and efficient replacement of worn portions of guide ring shrouds by removing and replacing modular wear body elements without the need for replacing the entire guide ring.

Laying Head System Overview

Referring generally to FIGS. 1-4, the laying head system 30 of the present invention coils rolled elongated material M, such as for example hot rolled steel rebar. Elongated material M that is advancing at speeds S up to approximately 500 feet/second (150 m/sec) is received in the laying head system 30 intake end 32 and discharged in a series of continuous coil loops at the discharge end 34, whereupon the coils are deposited on a conveyor 40.

The laying head system 30 includes a generally horn shaped quill 50 that rotates about an axis. A hollow laying pipe 60 has a generally helical axial profile of increasing radius, with a first end 62 that that is aligned with the rotational axis of quill 50 and receives elongated material discharged from the quill. The laying pipe 60 has a second end that is spaced radially outwardly from and generally tangential to the quill 50 rotational axis and thus discharges the elongated material generally tangentially to the rotating quill. The laying pipe 60 is coupled to a pipe support 70 that is in turn coupled coaxially to the quill 50, so that all three components rotate synchronously about the quill rotational axis. Quill 50 rotational speed is selected based upon, among other factors, the elongated material M structural dimensions and material properties, advancement speed S, and desired coil diameter.

In this embodiment, as elongated material M is discharged from the laying pipe second end 64, it is directed into a ring guide 80 having guide rim segments 82 into which are formed a guide trough channel 84 having a helical pitch profile, such as that described in commonly owned U.S. Pat. No. 6,769,641. As the elongated material M is advanced through the ring guide 80 it is conformed into a continuous loop helix.

As stated in the '641 patent, the segmented ring guide enables relatively easy reconfiguration of the ring guide helical pitch to accommodate different elongated materials by changing the rim segments 82 without disassembling and replacing the entire ring guide 80. Alternatively, a laying head system may be constructed with a solid structure ring guide or no ring guide at all.

As previously noted, the elongated material M is configured into a continuous looped coil as it rides within the ring guide 80 helical trough channel 84. Ring guide 80 is coupled to the pipe support 70 and rotates coaxially with the quill 50. The helical trough 84 advancement rotational speed is harmonized with the elongated material M advancement speed S, so there is little relative linear motion speed between the two abutting objects and less rubbing wear of the trough 84 surfaces that contact the coiling material.

Stationary end ring 90 has an inner diameter that is coaxial with the quill 50 rotational axis and circumscribes the laying pipe 60 second end 62 as well as the ring guide 80. The end ring 90 counteracts centrifugal force imparted on the elongated material M as it is discharged from the laying pipe 60 second end 62 and advances along the ring guide 80 helical trough channel 84 by radially restraining the material within the end ring inner diameter guide surface. High relative speed between the advancing elongated material M and the stationary end ring 90 causes rubbing wear on the end ring inner diameter guide surface.

Referring to FIG. 1, elongated material M that is discharged from the laying head system 30 falls by gravity in continuous loops on conveyor 40, aided by the downwardly angled quill rotational axis at the system discharge end 34. Tripper mechanism 150 pivots about an axis abutting the distal axial side of the end ring 90 guide surface. That pivotal axis is generally tangential to the end ring 90 inner diameter guide surface about a pivotal range of motion 9. As is known, coiled material M coiling characteristics and placement on the conveyor 40 can be controlled by varying the pivotal angle θ.

End Ring Structure

Figure 5:
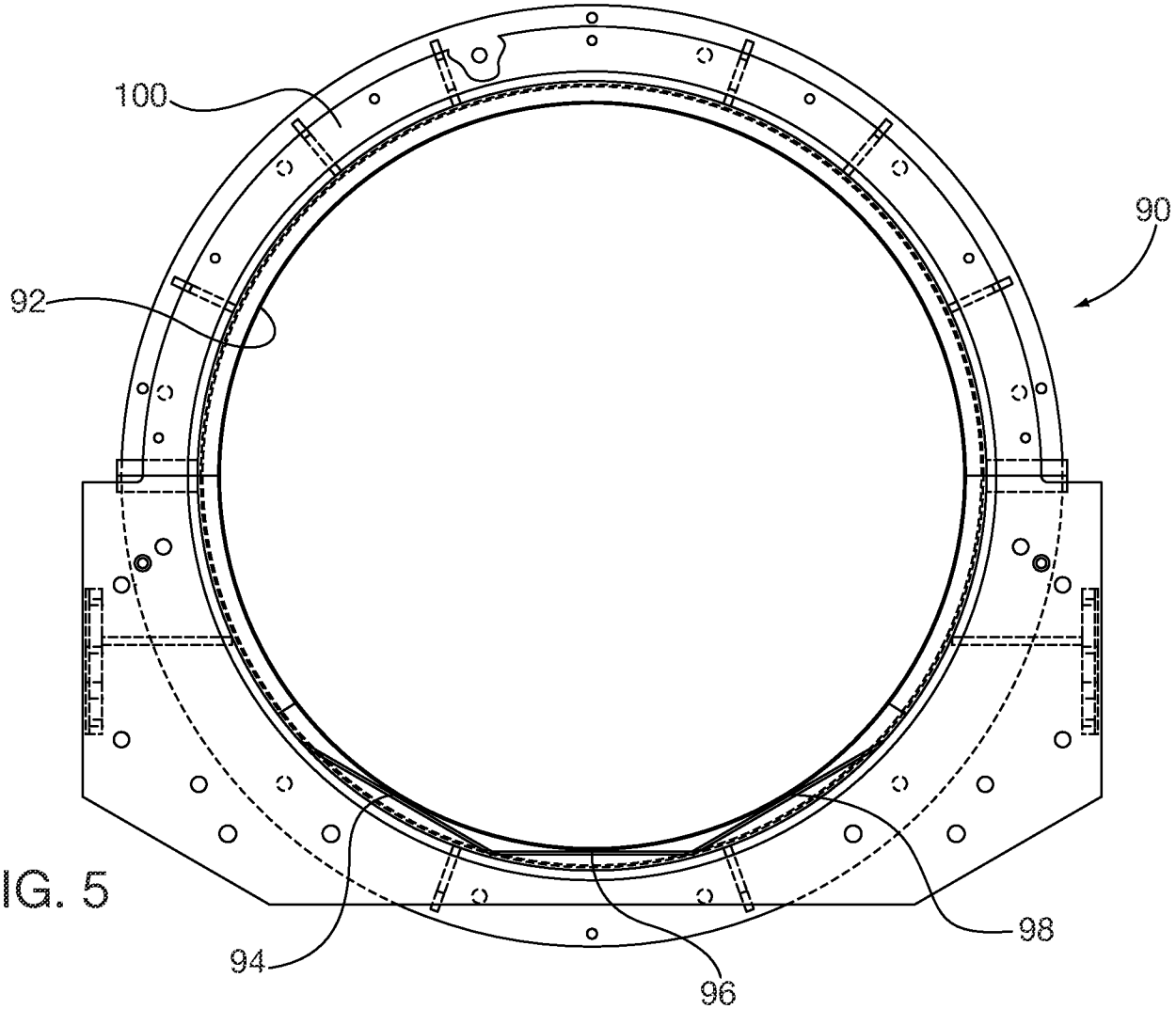
FIG. 5 shows an elevational view of the distal or discharge end of a laying head system end ring without a wear element body, in accordance with an exemplary embodiment of the present invention.
Figure 6:
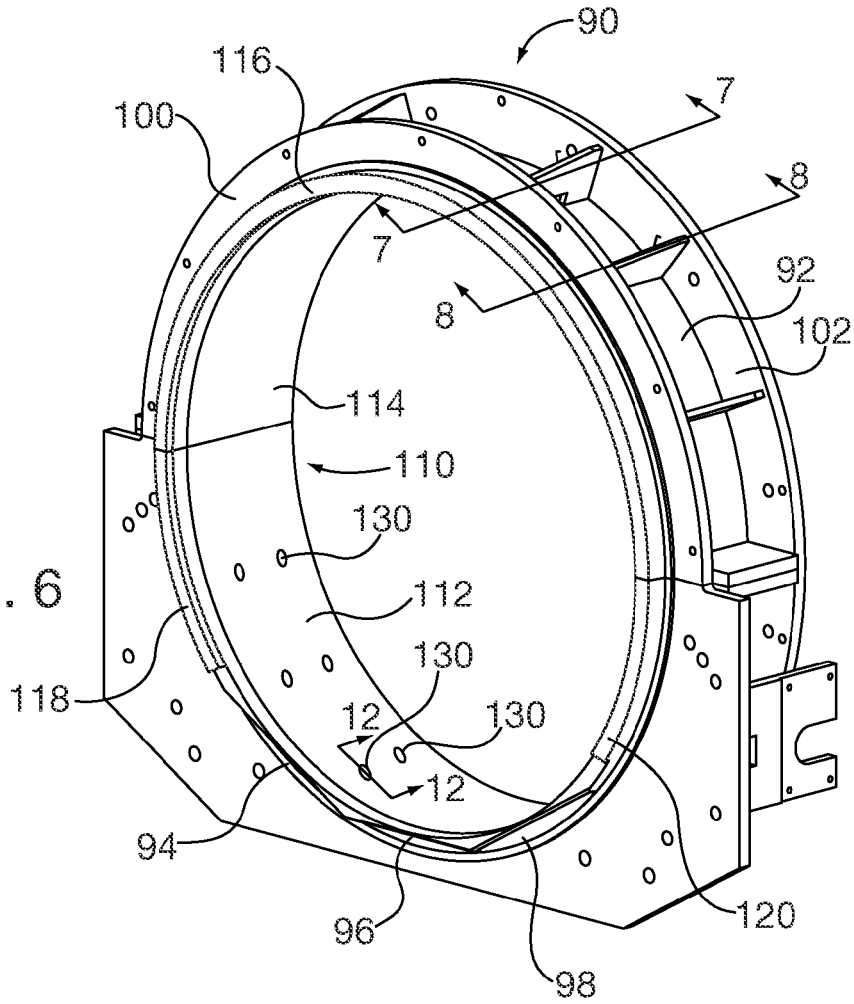
FIG. 6 shows a perspective view of the distal or discharge end of a laying head system end ring of FIG. 5, including an installed a wear element body, in accordance with an exemplary embodiment of the present invention.

Referring to FIGS. 5 and 6, the end ring 90 includes an annular support ring 92 of cylindrical or, alternatively, frustoconical profile flaring outwardly toward the distal or discharge axial end of the ring. The distal periphery of end ring 90 defines ring left notch 94, ring bottom notch 96 and ring right notch 98, for accommodation of tripper mechanism 150. Distal and proximal circumferential flanges 100, 102 and a series of axial gussets 104, 106 provide structural integrity to the end ring 90.

The guide end ring 90 embodiment shown in FIGS. 6-12 includes selectively replaceable wear surface 110 that defines the elongated material M circumferential guide surface circumscribing the laying pipe 60 discharge second end 62 and helical ring guide 80. During the laying head system 30 operation, the wear element 110 is worn away as the elongated material M rubs against it at high speed, but the annular support ring 92 backing the wear element remains intact. Thus the entire end ring structure 90 does not have to be replaced when its inner diameter defining the guide surface becomes worn. The present invention wear element 110 is constructed to facilitate efficient field replacement without necessity to remove the entire end ring 90 from the laying head system 30.

Referring to FIGS. 6-10, the replaceable wear element 110 has lower and upper annular split ring wear element bodies 112, 114 circumscribing the entire 360 degrees of the ring 90 inner diameter. Each of the annular wear element bodies 112, 114 has a curved inner diameter that defines the end ring 90 guide surface for constraining the elongated material M and an outer diameter having a profile that conforms to the shape of the guide ring annular support 92 inner diameter. While annular mating profiles between wear element 110 and the guide ring annular support 92 are shown in the figures herein, it should be understood that other mating profiles can be adopted in practicing the present invention. For example, one or more wear elements 110 and the end ring 90 can comprise mating polygonal profiles. Similarly, instead of having a unitary annular shaped support ring, an end ring can be constructed of a plurality of sector or other mating fabricated or castings segments. The assembled segments form the inner diameter circumferential guide surface that circumscribes the elongated material at the discharge end of the laying head.

Figure 7:
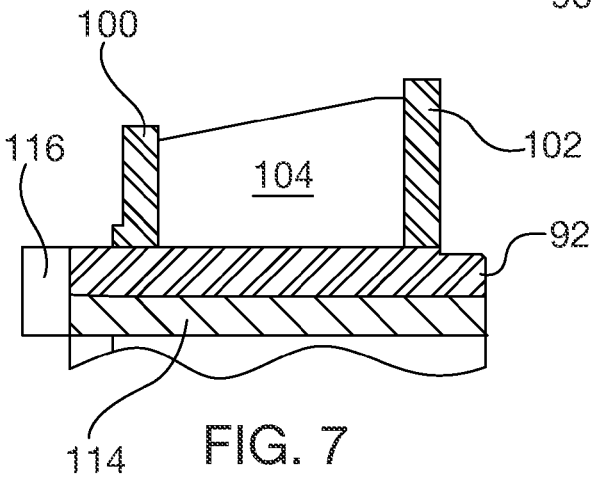
FIG. 7 shows a sectional view of the laying head system end ring of FIG. 6, taken along 7-7 thereof, in accordance with an exemplary embodiment of the present invention.
Figure 8:
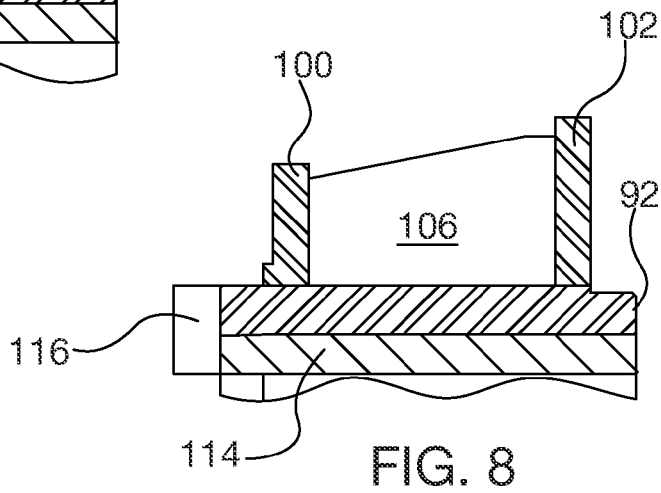
FIG. 8 shows a sectional view of the laying head system end ring of FIG. 6, taken along 8-8 thereof, in accordance with an exemplary embodiment of the present invention.
Figure 9:
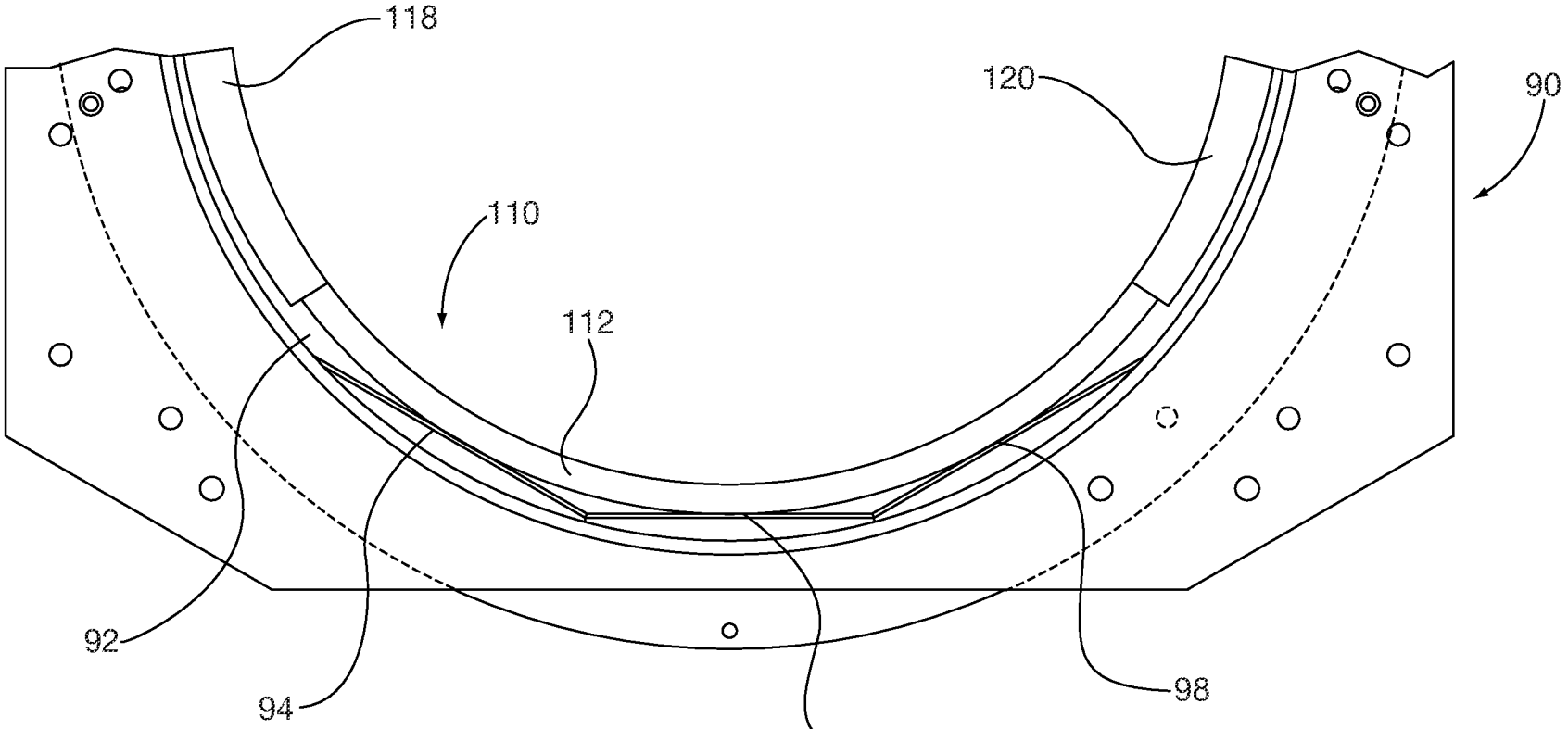
FIG. 9 shows a partial detailed elevational view of the lower portion of the end ring of FIG. 6, including clearance notches for the tripper mechanism, in accordance with an exemplary embodiment of the present invention.

As is shown in FIGS. 6-8, the wear element body includes respective upper, left and right wear element flanges 116, 118, 120 coupled in abutting relationship to the respective distal axial ends of the annular support ring 92 and the lower/upper annular split ring wear elements 112, 114. The abutting coupling provides additional structural integrity to end ring 90 and also protects the annular support ring 92 inner lip from wear contact with the elongated material as it is discharged from the laying head 30. Similar wear concern does not exist in this embodiment in the lower sector of the annular support ring proximal left, bottom and right notches 94, 96, 98, as that sector is shielded by the tripper mechanism.

In this exemplary embodiment in order to provide clearance for pivoting motion of the tripper mechanism 150 the lower annular split ring wear element 112 has respective left, bottom and right clearance notches 122, 124, 126 that abut the corresponding annular support ring notches 94, 96, 98. Inclusion of tripper mechanism clearance notches in either the wear element body 110 or the ring 90 or both is optional when practicing the present invention.

Figure 11:
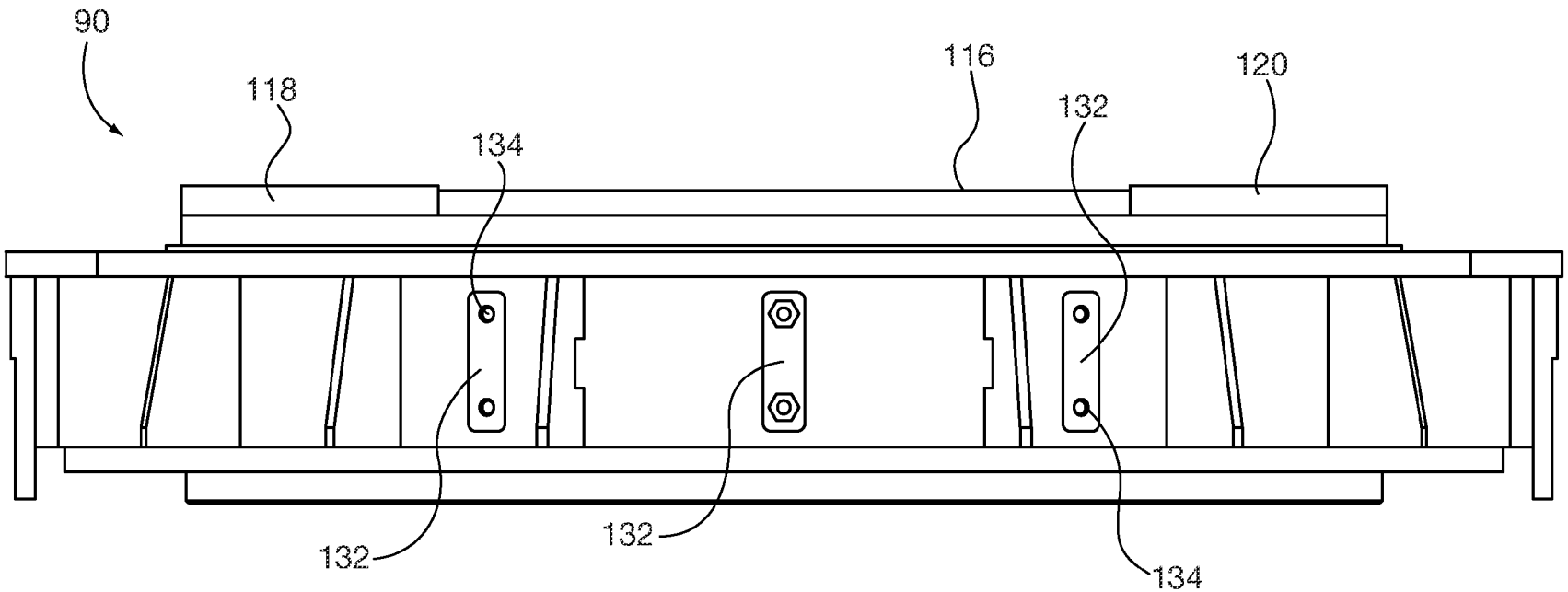
FIG. 11 shows a bottom plan view of the end ring of FIG. 7, in accordance with an exemplary embodiment of the present invention.
Figure 12:
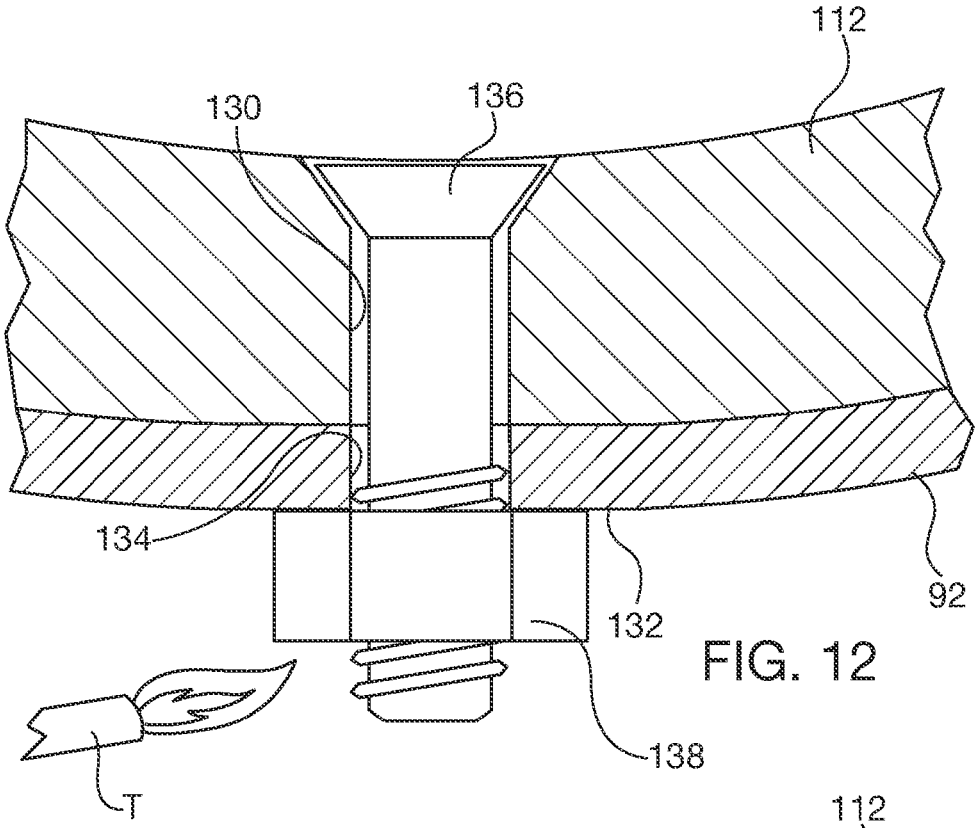
FIG. 12 shows a partial cross-sectional view of the end ring of FIG. 6, taken along 12-12 thereof, showing a fastening element for retaining a replaceable wear body element, in accordance with an exemplary embodiment of the present invention.

The wear element body 110 upper and lower annular split ring wear elements 112, 114 include a fastener engagement surface 130 that is adapted, for mating engagement with a fastening element, so that the wear body is rigidly coupled to the end ring 90. Referring to FIGS. 11 and 12, flat surfaces 132 are ground tangentially about the outer circumference of the annular support ring 92, and include pass-through apertures 134 for receipt of threaded screw fastener 136 and mating hex nut 138. The screw fastener 136 captures the lower annular split ring wear element 112 through the mating fastener engagement surface bore 130 that is formed in the wear body and the annular support ring 92 in mating abutting contact. Use of a threaded fastener 136 facilitates removal of a worn wear element 112 by removing the exposed outer end of the screw and it's mating nut 138 with a cutting torch T.

Figure 13:
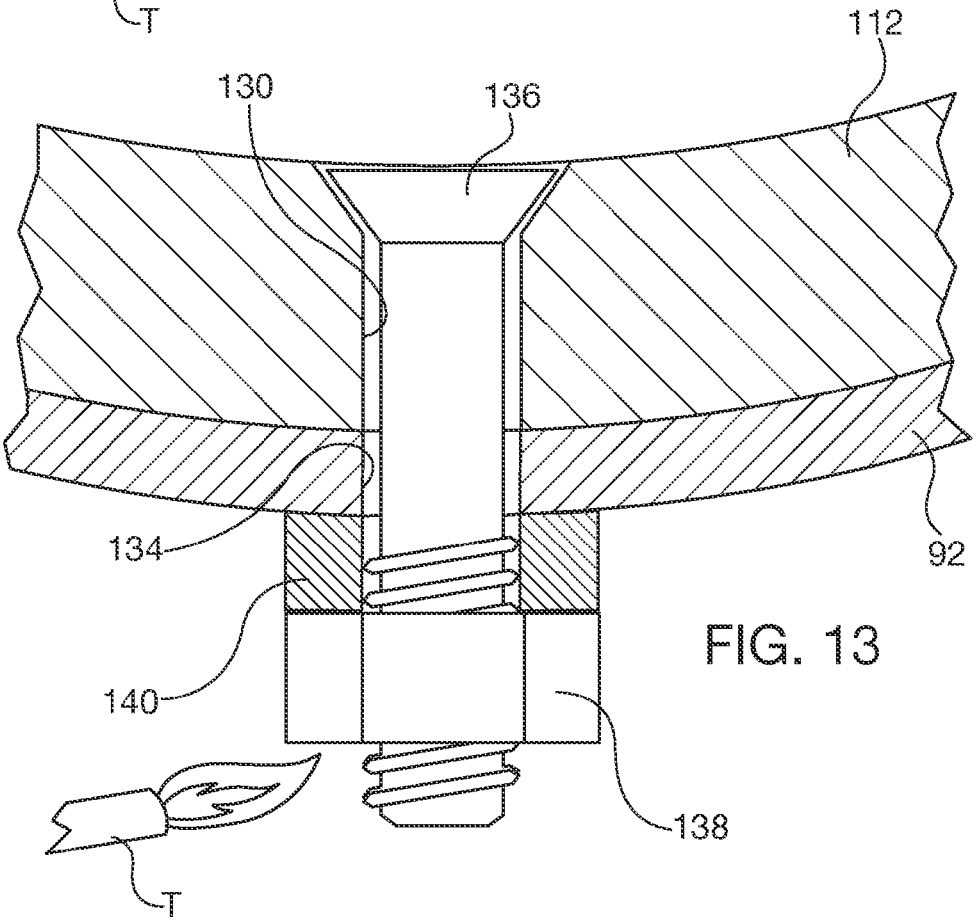
FIG. 13 shows a partial cross-sectional view of the end ring similar to that of FIG. 12, showing an alternative embodiment of fastening element for retaining a replaceable wear body element, in accordance with an exemplary embodiment of the present invention.
Figure 14:
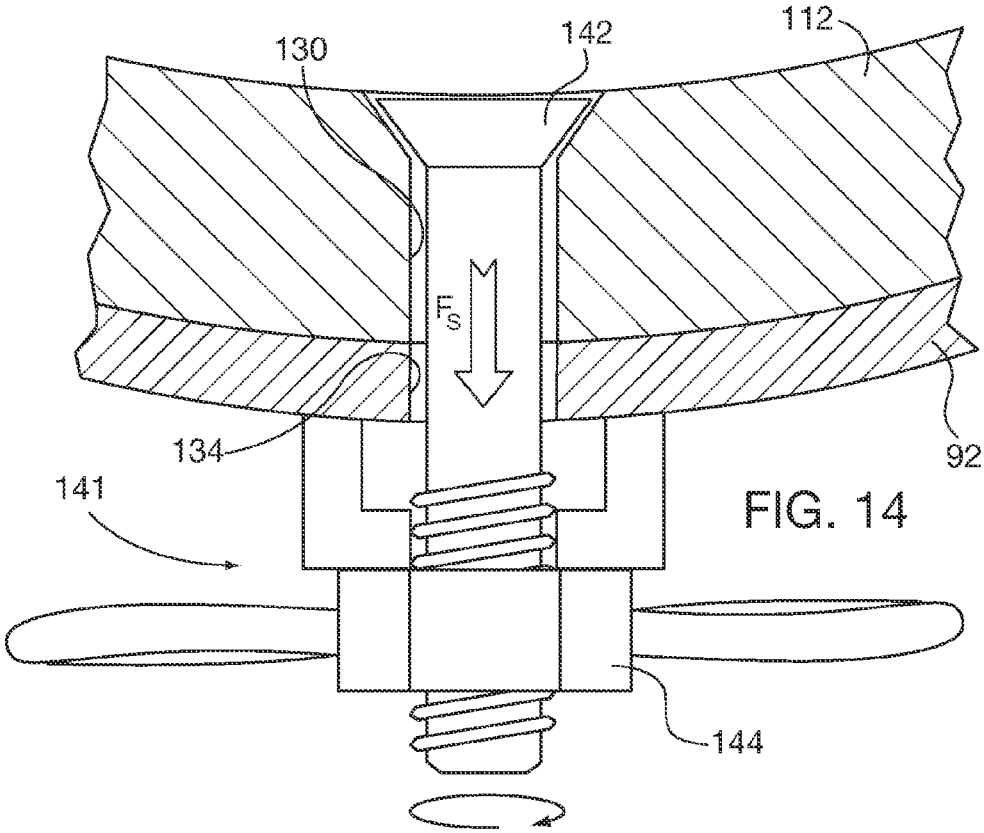
FIG. 14 shows a partial cross-sectional view of the end ring similar to that of FIG. 12, showing an alternative embodiment of a screw clamp fastening element for retaining a replaceable wear body element, in accordance with an exemplary embodiment of the present invention.
Figure 15:
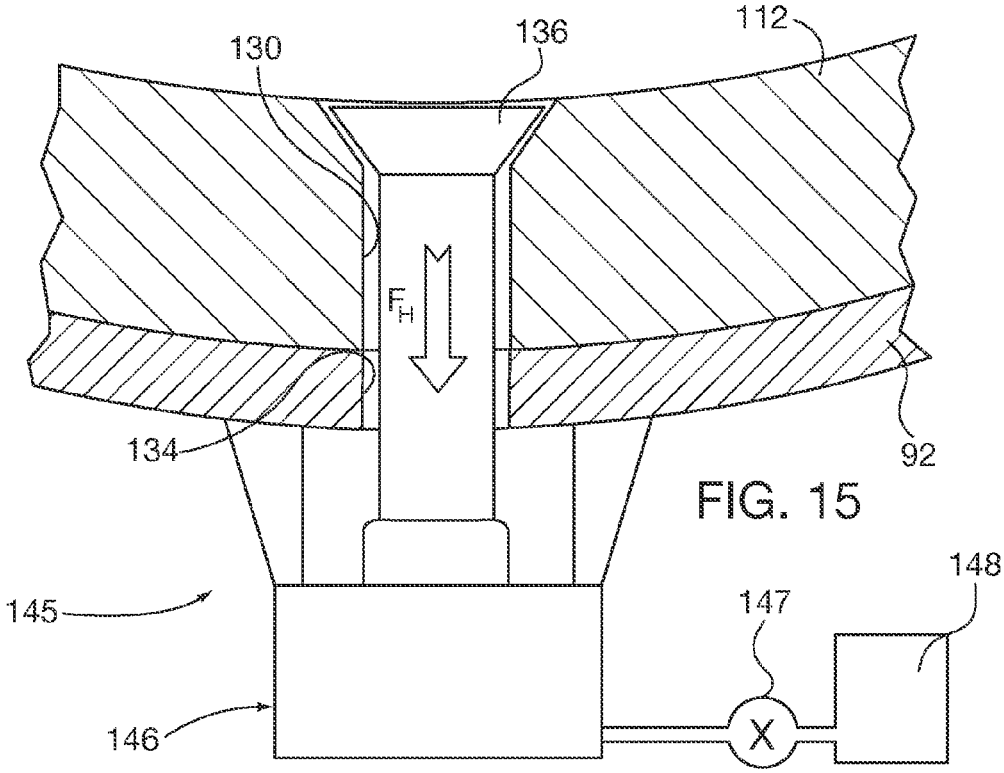
FIG. 15 shows a partial cross-sectional view of the end ring similar to that of FIG. 12, showing an alternative embodiment of a hydraulic-actuated clamp fastening element for retaining a replaceable wear body element, in accordance with an exemplary embodiment of the present invention.

Alternative ways to couple the wear element body 112 and the end ring 90 are shown in FIGS. 13-15. As shown in FIG. 13, a spacer sleeve 140 has a proximal side conforming to the annular support ring 92 outer radius and a flat distal side for abutment against the hex nut 138. The spacer sleeve 140 eliminates the need to grind a flat surface 132 into the annular support ring as was done in the embodiment of FIG. 12. The spacer sleeve 140 also increases the standoff distance between the hex nut 138 and the outer circumferential surface of the annular support ring 92, and concomitantly decreases likelihood that the support ring will be defaced by the cutting torch T during wear surface replacement.

Another alternative way to couple the wear element body 112 to the end ring 90 is by use of a clamp mechanism 141, including a clamp screw 142 and clamp nut 144. Rotating the clamp nut increases clamping force $F_S$ between the wear element 112 and the annular support ring. When wear element body 112 replacement is necessary it is removed by loosening the clamping mechanism 141. Similarly, the FIG. 15 exemplary fastening embodiment provides for rapid removal and replacement of a wear element by utilization of a hydraulic clamping mechanism. A fastener 136 is coupled to a pressurized hydraulic or pneumatic cylinder 146 that is in serial fluid communication with a control valve 147 and source of pressurized fluid 148. Clamping force $F_H$ retains the wear element body 112 within the end ring 90.

Any combination of the exemplary wear body 110 coupling mechanisms may be utilized in an end ring 90. For example, if it is contemplated that one or more sections of wear body 110 will be changed more frequently than other sections, it may be advantageous to utilize the clamping screw or hydraulic cylinder wear element body retention mechanisms of FIG. 14 or 15 for those sections, as they are quicker to disengage than the screw fastener embodiments of FIG. 12 or 13. Conversely, simpler screw fasteners may be suitable for wear element body 110 sections that will require less frequent replacement.

Figure 16:
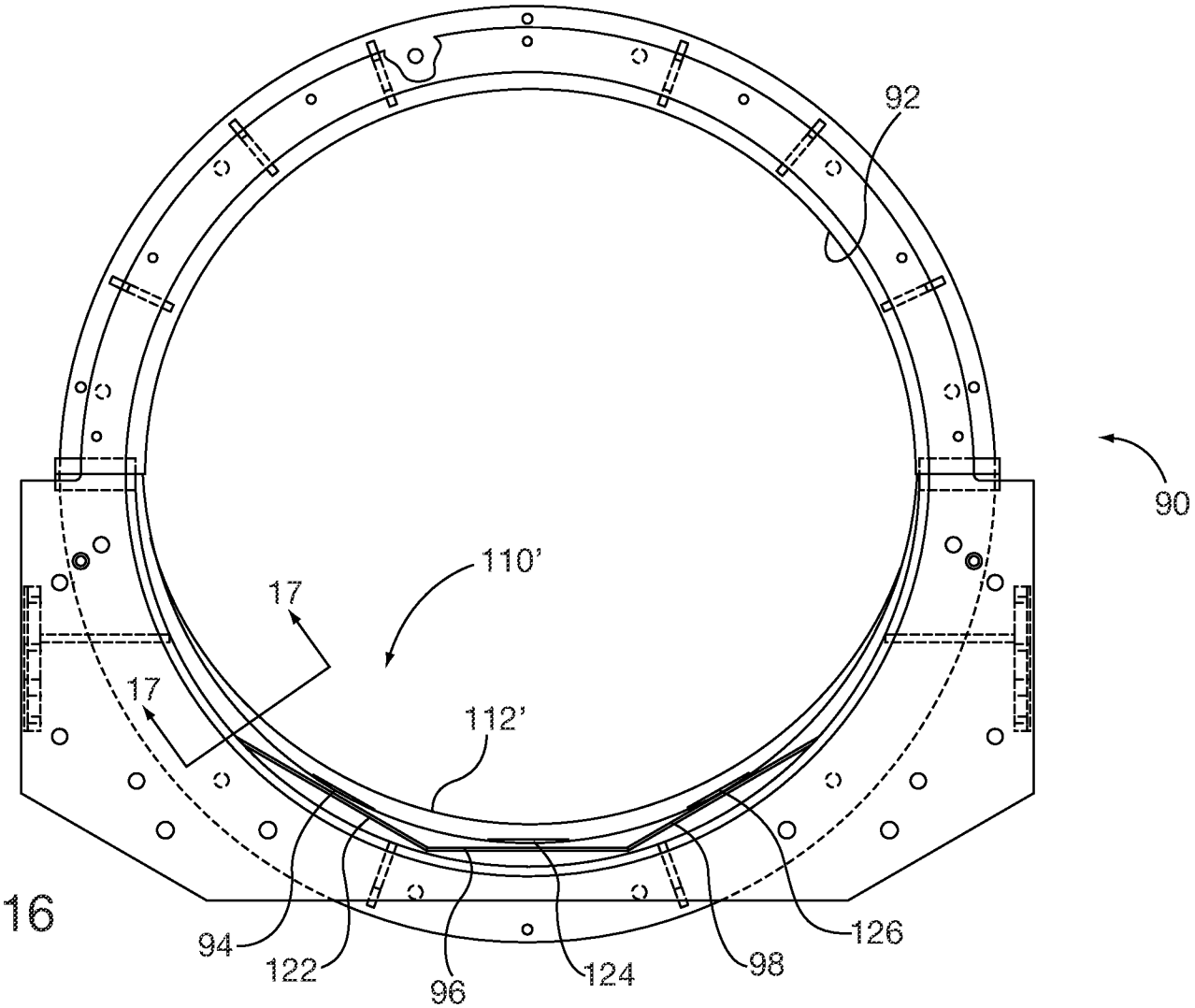
FIG. 16 shows an elevational view of the distal or discharge end of an alternative embodiment of a replaceable wear body element in a laying head system end ring, in accordance with an exemplary embodiment of the present invention.
Figure 17:
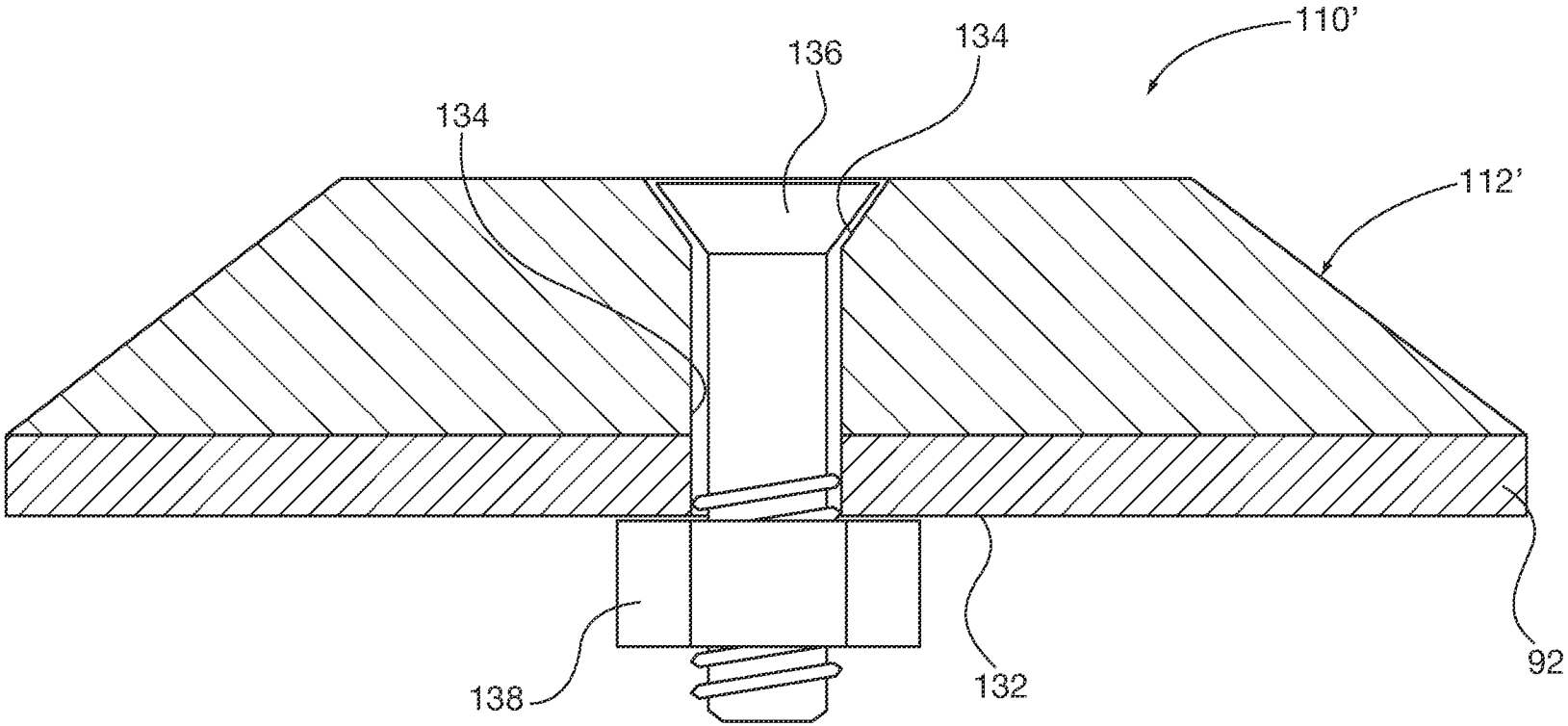
FIG. 17 shows a partial cross-sectional view of the end ring and wear body element of FIG. 16, taken along 17-17 thereof, in accordance with an exemplary embodiment of the present invention.

An alternative embodiment of wear element body 110' is shown in FIGS. 16 and 17. In this embodiment end ring 90 has a partial wear element 112' protecting the lower-most portion of the ring. The upper portion of the end ring 90 has no wear element body, allowing direct contact between the annular support ring 92 and the elongated material being coiled within the laying head. As shown in FIG. 17 the proximal and distal axial ends and circumferential terminations of the wear element body 112' are tapered for smooth transitional contact with elongated material, so that there is no stepped transition between the annular support ring 92 and the wear element body.

Figure 18:
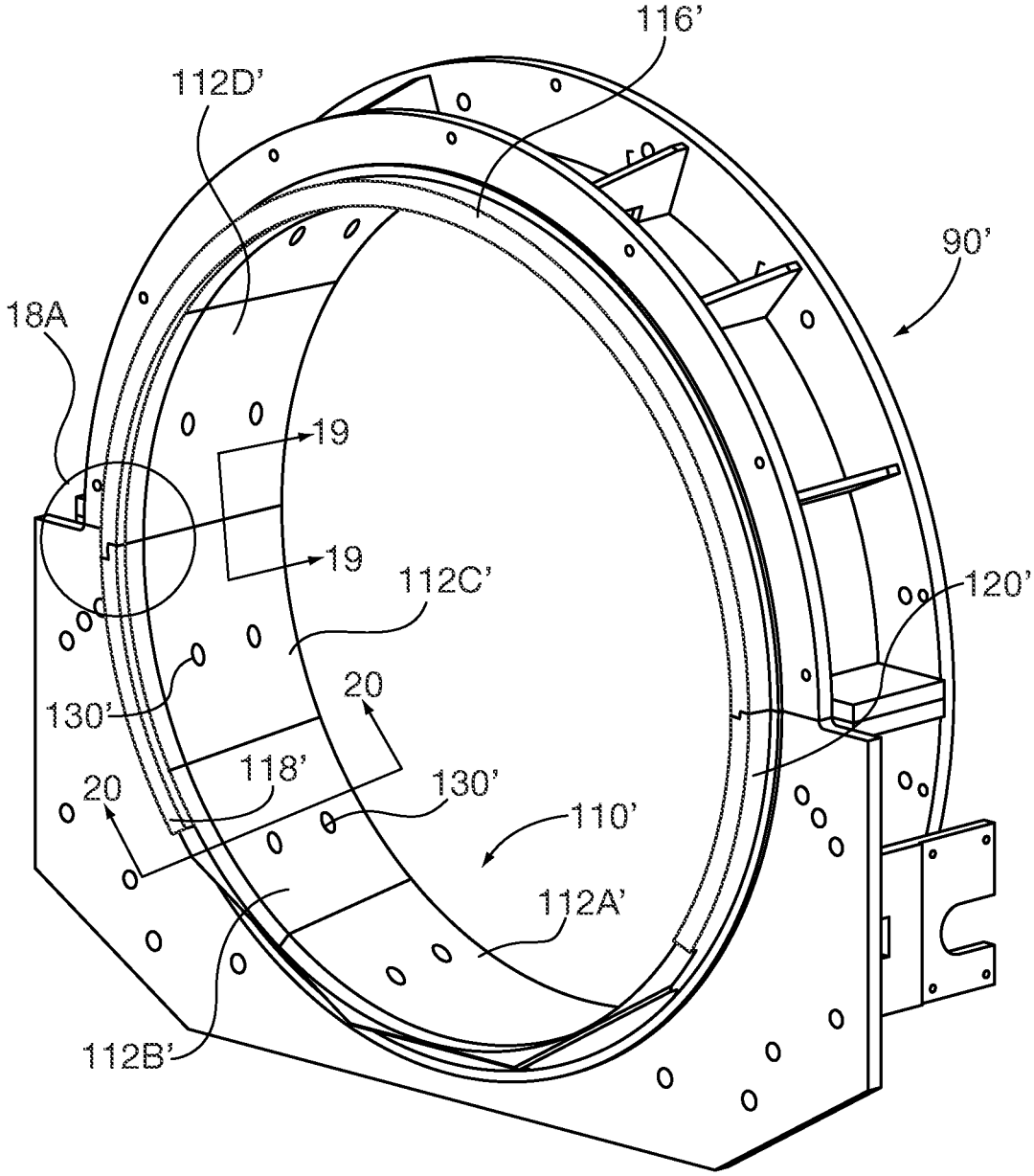
FIG. 18 is an elevational perspective view of an alternative embodiment of a replaceable wear body element in a laying head system end ring, with a series of laterally interlocking wear body elements, in accordance with an exemplary embodiment of the present invention.
Figure 18A:
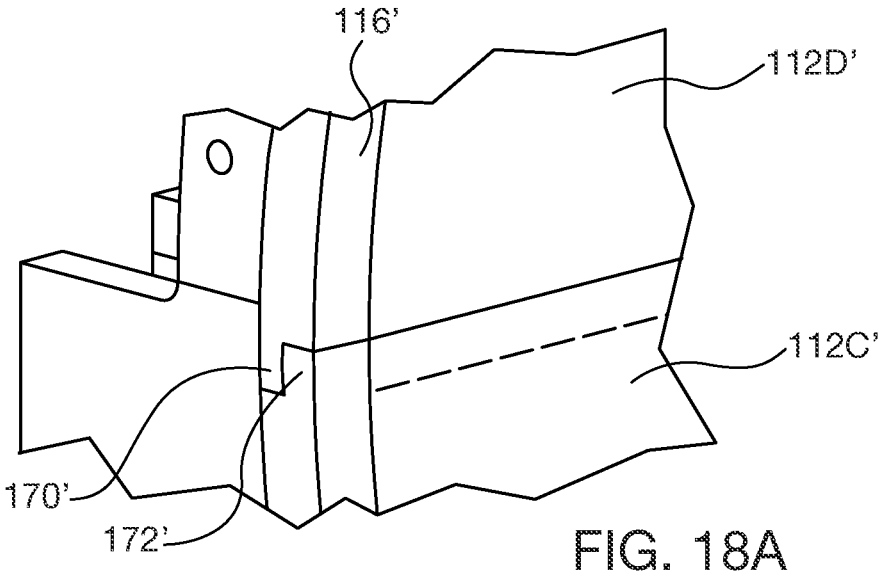
FIG. 18A is a detailed view of the replaceable wear body element of FIG. 18, in accordance with an exemplary embodiment of the present invention.
Figure 19:
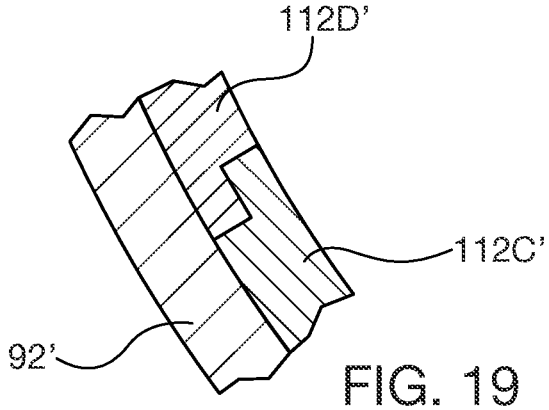
FIG. 19 is a cross-sectional view of the replaceable wear body element in the laying head system end ring of FIG. 18, taken along 19-19 thereof, in accordance with an exemplary embodiment of the present invention.
Figure 20:
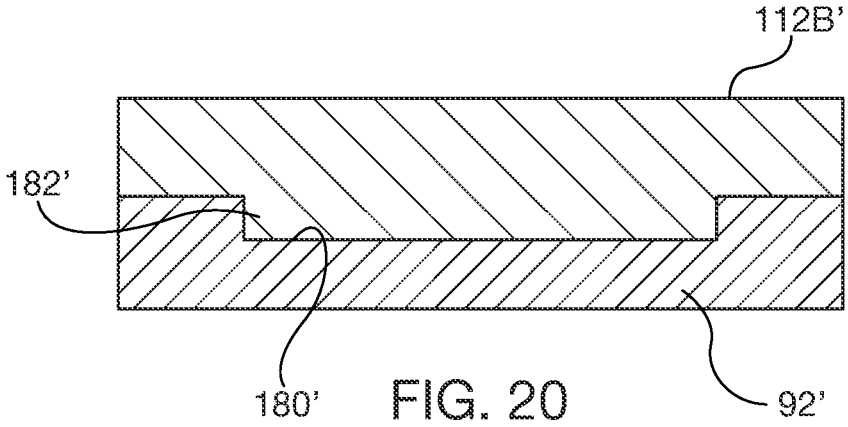
FIG. 20 is a cross sectional view of the replaceable wear body element in the laying head system end ring of FIG. 18, taken along 20-20 thereof, showing an interlocking axial reinforcing rib.

Another alternative embodiment of end ring 90' is shown in FIGS. 18-20, wherein the wear element body 110' has a plurality of sector shaped sections 112A'-112N' (where N=number of sections) about the annular support ring 92'. As shown in FIGS. 18A and 19, abutting wear element joints have complimentary interlocking tongue elements 170', 172' for increased structural integrity at their respective interfaces. Other forms of complementary interlocking structure may be utilized. In FIG. 18 three wear element flanges 116', 118' and 120' are shown, but the number may be increased or decreased. The annular support ring 92' has channels 180' formed therein for receipt of radially projecting ribs 182' that are formed within the wear element body 110', such as that shown in the mating wear element body 112' and ring 92' in FIG. 20. The complimentary interlocking channels 180' and ribs 182' advantageously increase structural integrity between the coupled wear element body 110' and end ring 90' in both the axial and radially tangential directions. Other forms of cooperating complimentary interlocking configurations may be utilized between the end ring 90 and wear body 110 elements. For example, ribs and channels can be reversed so that the channels are formed in the wear element body 110' and the ribs formed in the end ring 90'.

Use of replaceable wear element bodies 110, 110' also facilitates optimization of wear properties and fabrication efficiency within an end ring 90 or 90'. Wear element bodies can be constructed of a relatively harder material and/or heat treated to a greater hardness than the end ring 90 structural elements, such as the annular support ring 92. Generally it is more difficult to fabricate components from harder material, and heat treatment processes increase risk of work piece distortion. By practicing the present invention the end ring 90 structural components, such as the annular support ring 92, can be constructed of a softer steel and/or castings to ease their fabrication. Harmoniously, the wear elements 110 can be constructed of a harder, potentially costlier material, and/or given additional heat or other surface treatment than necessary for the purely structural support elements. For example, a wear element can be constructed of cold rolled 1020 series steel, then heat treated. Risk of heat treatment distortion can be reduced by using multiple sector-shaped wear elements within an end ring, so that small individual element distortion variations do not impede final assembly of the wear ring. Alternatively, wear elements 110 can be constructed of a harder material, such as AR 800 series steel, that while relatively more difficult to fabricate than milder steel, only comprise a relatively small portion of the effort needed to fabricate a complete end ring 90, 90'.

End Ring/Tripper Mechanism Interface

Figure 4:
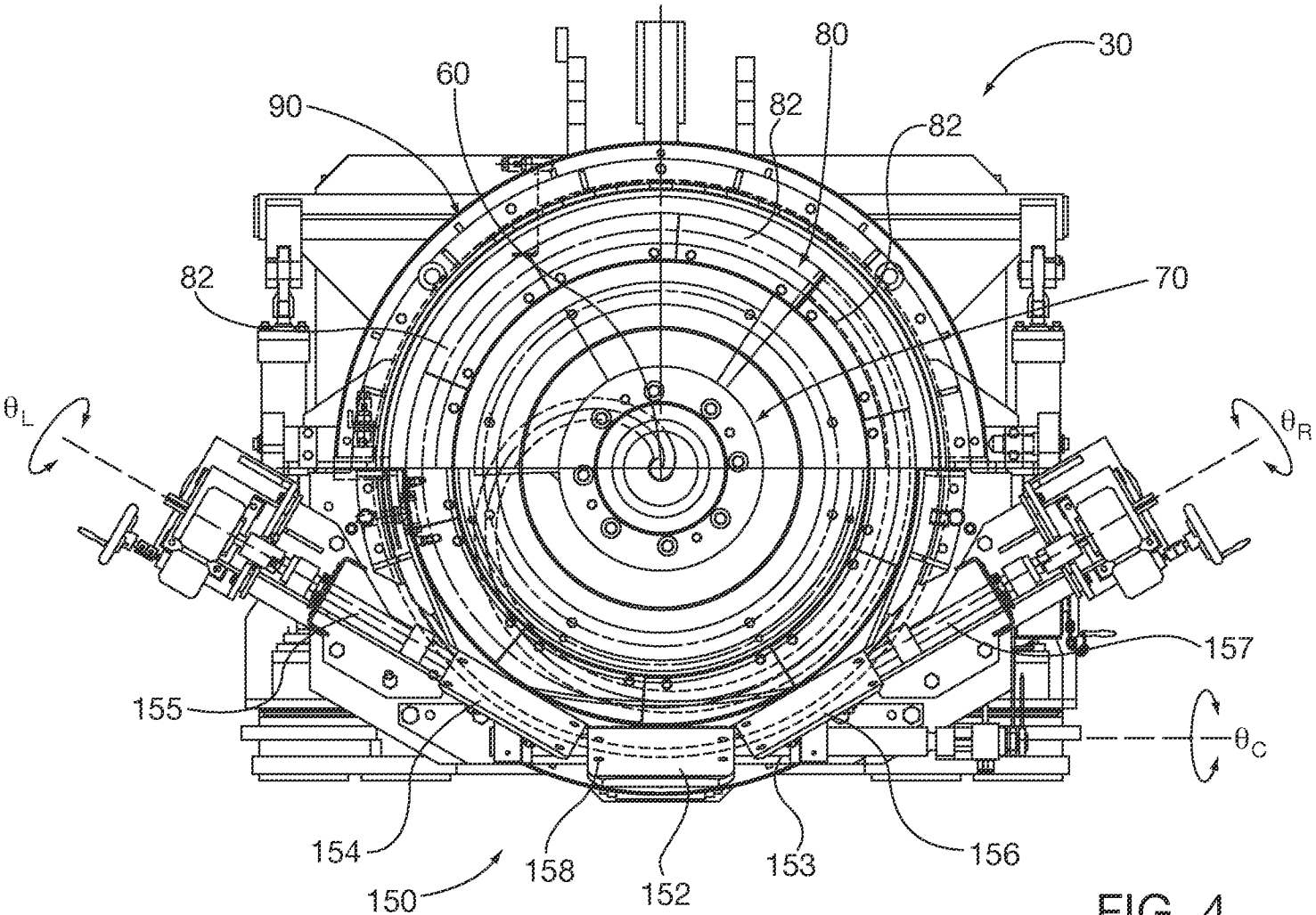
FIG. 4 shows an elevational view of the discharge end of the laying head system of FIG. 1, including its end ring and tripper mechanism, in accordance with an exemplary embodiment of the present invention.

As shown in FIGS. 1 and 4, tripper mechanism 150 is coupled to the laying head system 30 at the base of end ring 90. The tripper mechanism 150 includes three tripper paddles 152, 154, 156, the upper surfaces of which are control surfaces for orienting elongated material M as it discharges from the laying head 30. Independently varying the pivot angle θ between each tripper paddle upper surface and the end ring internal guide surface with its respective tripper actuator mechanism 153, 155, 157 alters downward slope at the laying head discharge end 34, and thus alters how the elongated material M coil loops fall on the conveyor.

Figure 10:
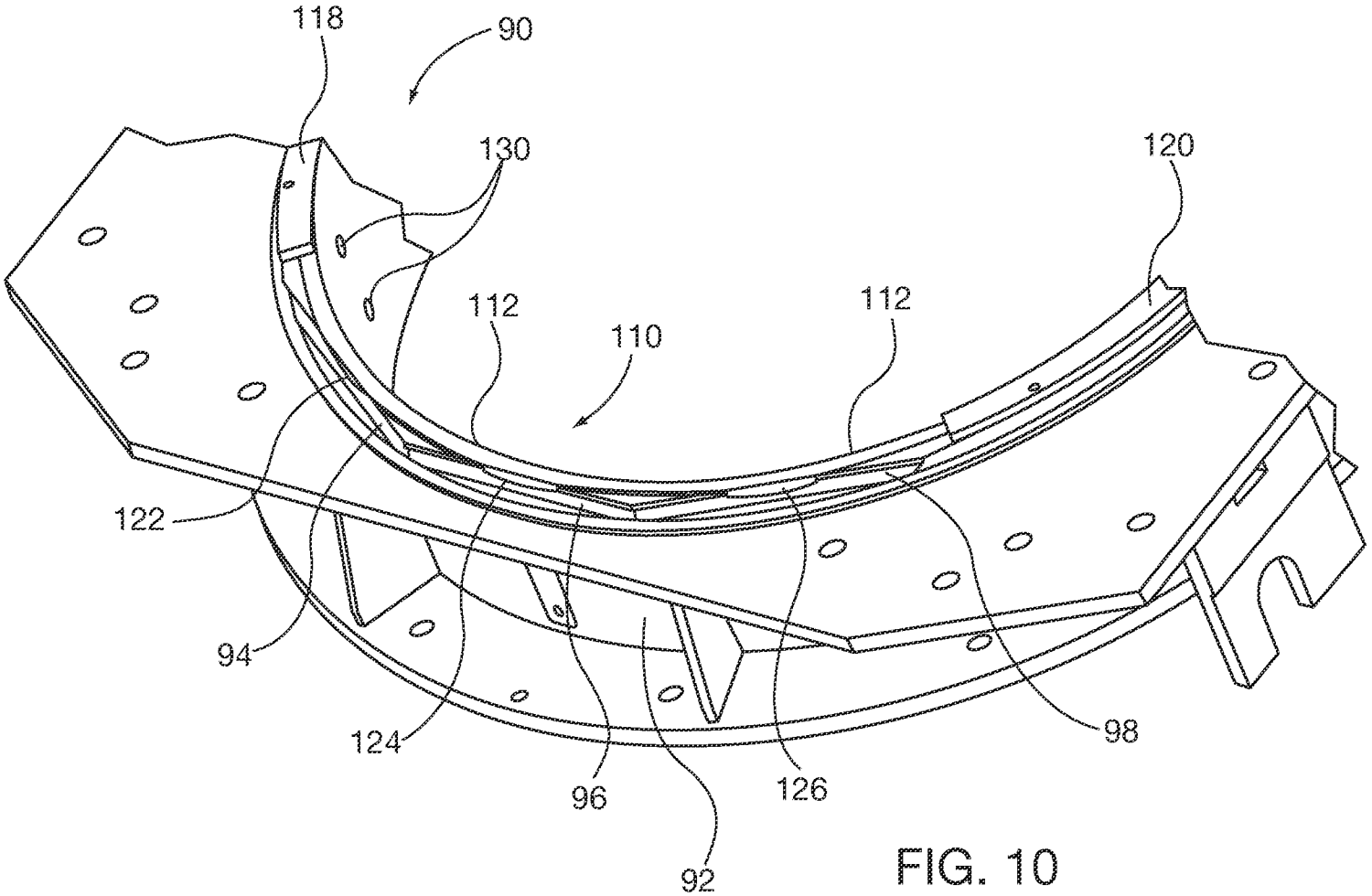
FIG. 10 shows a partial detailed bottom perspective view of the end ring of FIG. 6, including clearance notches for the tripper mechanism, in accordance with an exemplary embodiment of the present invention.

The end ring 90 and tripper mechanism 150 also facilitate rapid replacement of worn tripper paddles 152, 154, 156 without the need to remove the tripper actuator mechanism from the end ring. For example, center tripper paddle 152 is coupled to center tripper actuator mechanism 153 by removable fasteners 158 (e.g., machine screws and nuts). The paddle 152 along its pivot axis is oriented proximal the undercut ring bottom notch 96 and wear element body bottom notch 124 formed respectively in the annular support ring 92 and wear element body 112 (see FIG. 10), so that the elongated material M slides over a smooth transition between the end ring 90 guide surface and tripper mechanism 150. The structural cooperation between the tripper paddle 152 and the corresponding notches 96, 124 in the end ring 90 provides clearance for operation, removal and replacement the tripper paddle by removing the fasteners 158, directly from the open discharge end 34 of the laying head 30, without the need to remove the tripper actuator mechanism 153 from the end ring. Referring to FIGS. 4 and 10 the same structural cooperation exists between paddles 154 and 156, their associated respective actuator mechanisms and end ring clearance notches. The present invention is not restricted to use of three tripper paddles 152, 154, 156. One or more tripper paddles may be included in the tripper mechanism 150. Alternatively, a laying head can be constructed utilizing the end ring of the present invention without any tripper mechanism.

Laying Head Maintenance

The present invention facilitates relatively easy field repair and maintenance of a laying head system 30 by combination of one or more of modular replaceable laying pipe 60, helical ring 80 rim segments 82, end ring 90 wear element bodies 110 and tripper mechanism 150 paddles 152, 154, 156. The laying head system does not require total disassembly in order to replace any of these modular components. More particularly, the laying pipe 60 can be replaced without disassembling the entire quill structure 50, the pipe support 70, helical ring 80 or end ring 90. Rim segments 82 can be jointly or severally replaced without removing the entire helical ring 80 structure. Similarly, wear element body 110 segments, such as 112, 114, 112' or 112A-N' and tripper paddles 152, 154, 156 can be removed from the laying head 30 discharge end 34 without removing the entire end ring 90 structure or the tripper mechanism 150.

Existing end rings, whether unused or already worn through field use, can be retrofitted with replaceable guide surfaces by lining the existing annular ring inner diameter with wear element bodies, using the installation methods of the present invention. The existing ring inner diameter can be reconditioned to replace worn surfaces using known repair techniques, such as installation of replacement metal patches, weld bead build up, or by hot plasma deposition, and subsequent grinding to achieve a desired surface finish. If the existing end ring has relatively little wear a wear element body can be installed without the necessity of ring reconditioning. Pass-through apertures can be formed in the existing ring to facilitate fastening of the wear element body lining to the ring inner diameter.

A method for selectively replacing a guide surface of a guide ring of a laying head system for coiling hot rolled elongated material. The system has: a quill rotating about an axis, for discharging elongated, material therefrom; a pipe support coaxial with the quill rotational axis; and a hollow elongated member, such as a laying pipe, coupled to the pipe support, for passage of elongated material there through, the laying pipe or other hollow elongated member having a first end generally aligned with the quill rotational axis for receiving elongated material discharged from the quill, and a second end radially spaced from the rotational axis for discharging elongated material generally tangentially relative to the rotational axis. The system also has a generally annular end ring coaxial with the quill rotational axis, for guiding elongated material discharged from the laying pipe second end into a continuous coil that is in turn discharged from the end ring. The end ring further has an inner diameter radially and axially circumscribing the laying pipe second end and defines respective axial sides proximal and distal the quill. The end ring also defines an axially inset notch within its distal side. The inset notch further defines a notch face surface. A pivoting tripper is coupled to the end ring along the distal side by a pivotal axis that is generally tangential to the end ring inner diameter, for selectively orienting the elongated material coil discharged from the end ring by varying pivotal angle between the tripper and the end ring. The tripper has a tripper control surface inset within and abutting the end ring notch that in cooperation with the adjoining notch face guides discharged elongated material into a formed loop. The method for selectively replacing the guide surface comprises providing a wear element body having: a curved inner surface defining at least a portion of the guide surface and notch face; an outer surface having a profile conforming with the guide ring inner diameter that is adapted for mated coupling with the guide ring inner diameter; and an engagement surface adapted for mating engagement with a fastening element that is coupled to the end ring, the wear element body, when engaged with the fastening element and end ring, forming a portion of the guide ring wear surface. The method further comprises mating the wear body outer surface with a corresponding surface of the end ring inner diameter; and fastening the fastening element to the end ring and the wear body engagement surface, thereby forming at least a portion of the end ring guide wear surface with the wear body inner surface.

Selectively replaceable wear surfaces in a laying head system for coiling hot rolled elongated material. The system has: a quill rotating about an axis, for discharging elongated material therefrom; a pipe support coaxial with the quill rotational axis; a hollow elongated member, such as a laying pipe, coupled to the pipe support, for passage of elongated material there through. The hollow elongated laying pipe has a first end generally aligned with the quill rotational axis for receiving elongated material discharged from the quill, and a second end radially spaced from the rotational axis for discharging elongated material generally tangentially relative to the rotational axis. A generally annular end ring is coaxial with the quill rotational axis, for guiding elongated material discharged from the laying pipe second end into a continuous coil that is in turn discharged from the end ring. The end ring has an inner diameter radially and axially circumscribing the elongated hollow member laying pipe second end, and defines respective axial sides proximal and distal the quill, and an axially inset notch defined within the end ring proximal the guide surface distal side. The inset notch further defines a notch face surface. A pivoting tripper mechanism is coupled to the end ring along the guide surface distal side by a pivotal axis that is generally tangential to the end ring inner diameter, for selectively orienting the elongated material coil discharged from the end ring by varying pivotal angle between the tripper and the end ring, the tripper has a tripper control surface inset within and abutting the end ring notch, that in cooperation with the adjoining end ring inner diameter guides discharged elongated material into a formed loop. The selectively replaceable laying head wear surfaces comprise an end ring wear element body having a curved inner surface defining at least a portion of the guide surface and notch face; an outer surface having a profile conforming with the guide ring inner diameter that is adapted for mated coupling with the guide ring inner diameter; and an engagement surface adapted for mating engagement with a fastening element that is coupled to the end ring. The wear element body, when engaged with the fastening element and end ring, forms a portion of the guide ring replaceable wear surface. The selectively replaceable wear surfaces may further comprise a tripper wear element having a tripper paddle defining the tripper control surface coupled to the tripper mechanism external the end ring; and selectively removable tripper fasteners coupling the tripper paddle to the tripper mechanism, that are accessible for removal external the end ring.

Although various embodiments which incorporate the teachings of the present invention have been shown and described in detail herein, those skilled in the art can readily devise many other varied embodiments that still incorporate these teachings.

What is claimed is:

1. In a laying head system for coiling hot rolled elongated material, the system having a generally annular end ring for guiding elongated material discharged from the laying head into a continuous coil that is in turn discharged from the end ring, the end ring having an inner diameter radially and axially circumscribing the elongated material and defining respective proximal and distal axial sides, a selectively replaceable guide surface lining at least a portion of the end ring inner diameter comprising a wear element body having:

a curved inner surface defining at least a portion of the guide surface;

an outer surface having a profile conforming with a guide ring inner diameter that is adapted for mated coupling with the guide ring inner diameter; and an engagement surface adapted for mating engagement with a fastening element that is coupled to the end ring, the wear element body, when engaged with the fastening element and end ring, forming at least a portion of the guide surface.

2. The replaceable guide surface of claim 1, further comprising a peripheral flange abutting the wear element body and adapted for coupling to an end ring distal axial side.

3. The replaceable guide surface of claim 1, further comprising first and second wear element bodies having respective mating elements adapted for interlocking lateral engagement there between when coupled in abutting relationship within an end ring.

4. The replaceable guide surface of claim 1, further comprising a second engagement surface on the wear element body outer surface that is adapted for interlocking engagement with a complementary third engagement surface defined within an end ring inner diameter.

5. The replaceable guide surface of claim 1, wherein the wear element body comprises a plurality of wear element bodies adapted for collectively forming the entire guide surface upon coupling to an end ring.

6. The replacement guide surface of claim 1, wherein the engagement surface is adapted for mating engagement with a fastening element selected from the group consisting of threaded screws, screw clamping mechanisms and hydraulic clamping mechanisms.

7. The replacement guide surface of claim 1, wherein the wear element body defines a clearance notch proximal an end ring distal axial side, adapted for proximal orientation with a pivoting tripper mechanism.

8. In a laying head system for coiling hot roiled elongated material, the system having a generally annular end ring for guiding elongated material discharged from the laying head into a continuous coil that is in turn discharged from the end ring, the end ring having an inner diameter radially and axially circumscribing the elongated material and defining respective proximal and distal axial sides, a method for selectively replacing a guide surface lining at least a portion of the end ring inner diameter comprising:

providing a wear element body having:

a curved inner surface defining at least a portion of the guide surface;

an outer surface having a profile conforming with the guide ring inner diameter that is adapted for mated coupling with the guide ring inner diameter;

an engagement surface adapted for mating engagement with a fastening element that is coupled to the end ring, the wear element body, when engaged with the fastening element and end ring, forming a portion of the guide surface;

mating the wear element body outer surface with a corresponding surface of the end ring inner diameter; and fastening a fastening element to the end ring and the wear body engagement surface, thereby forming at least a portion of the end ring guide surface with the wear body inner surface.

9. The method of claim 8, wherein the mating step is performed by inserting the wear element body into the end ring from the end ring distal axial side without separating the end ring from the laying head system.

10. The method of claim 8, wherein the fastening step is performed by:

providing a fastening element selected from the group consisting of threaded screws, screw clamping mechanisms and hydraulic clamping mechanisms;

inserting the fastening element into the wear element body engagement surface;

passing the fastening element through the end ring inner diameter exterior the end ring; and coupling the wear element body to the end ring by tightening the fastening element.

11. The method of claim 8 further comprising:

providing a pivoting tripper with a tripper paddle mechanism having a pivot axis, and coupling the tripper mechanism exterior the end ring proximal the guide surface distal axial end; and selectively replacing the tripper paddle or wear element body exterior the end ring without separating the tripper paddle mechanism from the laying head system.

12. The method of claim 8 further comprising retrofitting a laying head end ring to include the selectively replaceable wear element lining by preparing the end ring inner diameter to receive the replaceable wear element body and fastening elements, and coupling the wear element body to the end ring with the fastening elements.

13. A laying head system for coiling hot rolled elongated material, comprising:

a generally annular end ring for guiding elongated material discharged from the laying head into a continuous coil, the end ring having an inner diameter radially and axially circumscribing the elongated material, the end ring defining respective proximal and distal axial sides;

a fastening element coupled to the end ring; and a selectively replaceable guide surface wear element body having:

a curved inner surface defining at least a portion of the guide surface;

an outer surface having a profile conforming with the guide ring inner diameter that is coupled to the guide ring inner diameter; and an engagement surface coupled to the fastening element, the wear element body, when engaged with the fastening element and end ring, forming a portion of the guide surface.

14. The system of claim 13, further comprising a peripheral flange abutting the wear element body and adapted for coupling to the distal axial side of the end ring.

15. The system of claim 13, further comprising first and second wear element bodies having respective mating elements in interlocking lateral engagement there between that are coupled in abutting relationship within the end ring.

16. The system of claim 13, further comprising a second engagement surface on the wear element body outer surface in interlocking engagement with a complementary third engagement surface defined within the end ring inner diameter.

17. The system of claim 13, wherein the wear element body comprises a plurality of wear element bodies collectively forming the entire end ring guide surface.

18. The system of claim 13, wherein the fastening element selected from the group consisting of threaded screws, screw clamping mechanisms and hydraulic clamping mechanisms.

19. The system of claim 13, further comprising:

a pivoting tripper mechanism, having a pivot axis, coupled to the end ring proximal the distal axial end of the end ring; and a clearance notch defined by the wear element body proximal the end ring distal axial side, adapted for proximal orientation with the tripper mechanism pivot axis.

20. The system of claim 19 wherein the tripper control surface further comprises a selectively replaceable tripper paddle coupled by removable fasteners to the tripper along the pivotal axis exterior the end ring.

* * * * *